US009631429B2

(12) United States Patent
Anderson

(10) Patent No.: US 9,631,429 B2
(45) Date of Patent: Apr. 25, 2017

(54) LADDER FLAG STORAGE DEVICE

(71) Applicant: Eric Anderson, Fountain Hills, AZ (US)

(72) Inventor: Eric Anderson, Fountain Hills, AZ (US)

( * ) Notice: Subject to any disclaimer, the term of this patent is extended or adjusted under 35 U.S.C. 154(b) by 177 days.

(21) Appl. No.: 14/692,694

(22) Filed: Apr. 21, 2015

(65) Prior Publication Data

US 2016/0168909 A1 Jun. 16, 2016

Related U.S. Application Data

(60) Provisional application No. 62/090,525, filed on Dec. 11, 2014.

(51) Int. Cl.

| | |
|---|---|
| ***E06C 7/00*** | (2006.01) |
| ***G09F 17/00*** | (2006.01) |
| ***G09F 21/04*** | (2006.01) |

(52) U.S. Cl.

CPC ..... *E06C 7/003* (2013.01); *G09F 17/00* (2013.01); *G09F 21/04* (2013.01); *G09F 2017/0025* (2013.01); *G09F 2017/0083* (2013.01)

(58) Field of Classification Search

CPC ..... G09F 17/00; G09F 17/0091; G09F 2017/0025; G09F 2017/005; G09F 2017/0066; G09F 2017/0075; G09F 2017/0083; E06C 7/003

USPC ..... 116/173, 174, 175, 28 R; 40/586, 601, 40/610

See application file for complete search history.

(56) References Cited

U.S. PATENT DOCUMENTS

| | | | | |
|---|---|---|---|---|
| 2,166,520 A * | 7/1939 | Challoner | G08B 5/02 | 116/28 R |
| 2,327,056 A * | 8/1943 | Nelson | E04H 12/32 | 116/173 |
| 2,377,219 A * | 5/1945 | Ellis | G09F 17/00 | 116/173 |
| 3,797,450 A * | 3/1974 | Frisbee | G09F 17/00 | 116/173 |
| 4,565,152 A * | 1/1986 | Bennett | B60Q 1/50 | 116/173 |
| 4,807,557 A * | 2/1989 | Lodisio | G08B 5/02 | 116/173 |
| 5,685,255 A * | 11/1997 | Arzu | B60Q 7/02 | 116/173 |
| 6,119,621 A * | 9/2000 | Johnson | E01F 13/02 | 116/63 C |
| 6,789,496 B2 * | 9/2004 | Gehris | G09F 17/00 | 116/173 |

(Continued)

FOREIGN PATENT DOCUMENTS

| | | | |
|---|---|---|---|
| DE | 4017945 A1 * 12/1991 | E06C 7/003 | |
| DE | 4407438 A1 * 9/1995 | G09F 17/00 | |

*Primary Examiner* — Richard A Smith

(74) *Attorney, Agent, or Firm* — Morgan Law Offices, PLC

(57) ABSTRACT

The present disclosure relates to a ladder-mountable storage device for storing and retractably deploying a flag. The flag can be displayed on the end of a ladder to warn onlookers. If used on the end of a ladder extending from a vehicle, the flag warns drivers to keep a safe distance, for example. The ladder-mountable storage device can also be attached to the top of ladders placed alongside buildings and other structures.

20 Claims, 3 Drawing Sheets

(56) References Cited

U.S. PATENT DOCUMENTS

| | | | | |
|---|---|---|---|---|
| 7,426,899 | B1 * | 9/2008 | Heva | G09F 17/00 116/173 |
| 7,584,823 | B2 * | 9/2009 | Guering | B64D 11/00 182/97 |
| 8,167,088 | B2 * | 5/2012 | Kuhlman | E06C 7/003 182/108 |
| 2006/0201746 | A1 * | 9/2006 | Jackson | E06C 7/003 182/204 |
| 2010/0083546 | A1 * | 4/2010 | Troiano et al. | G09F 15/0018 40/603 |
| 2015/0000587 | A1 * | 1/2015 | Chaney | G09F 17/00 116/173 |

* cited by examiner

LADDER FLAG STORAGE DEVICE

CROSS-REFERENCE TO RELATED APPLICATIONS

This application claims the benefit of provisional application Ser. No. 62/090,525 to Eric Anderson, entitled "LADDER FLAG STORAGE DEVICE," filed on Dec. 11, 2014, the subject matter of which is incorporated herein by reference.

BACKGROUND OF THE INVENTION

1. Field of the Invention

The present invention relates generally to storage devices. More particularly, the present invention relates to a ladder-mountable storage device for storing and retractably deploying a flag.

2. Description of the Related Art

The U.S. Department of Transportation (DOT) requires that any object extending more than four feet out from the rear end of a vehicle must be marked with a bright orange or red flag. This is especially common in construction and contracting work when vehicles need to transport long ladders between work sites. The high-visibility flag is meant to help drivers maintain safe following distances from vehicles with oversized loads. If the object, such as a ladder, is not clearly marked it may be difficult for drivers to see and judge how far out from the vehicle the object extends. Flags or other markers may be used to mark ladders in other situations when safety is of high concern. For example, the Occupational Safety and Health Administration (OSHA) require that any ladder which exceeds certain height limits must have a highly visible flag or other marker placed at the top.

Currently, most people will simply tie flags, towels, or other similar fabric bodies to ladders. There are several problems with this. First, a flag that is poorly tied around the side rail or rung of a ladder is subject to coming loose and ultimately being lost, especially if subject to high winds or bumpy roads while driving. Second, this leaves flags exposed to the elements; they become wet, dirtied, and may eventually become sun-bleached if left out for too long. This creates a hassle when the flag must constantly be tied and untied to either wash it or store it.

SUMMARY OF THE INVENTION

The present disclosure relates to a ladder-mountable storage device for storing and retractably deploying a flag. The flag can be displayed on the end of a ladder to warn onlookers. If used on the end of a ladder extending from a vehicle, the flag warns drivers to keep a safe distance. The ladder-mountable storage device can also be attached to the top of ladders placed alongside buildings and other structures.

In an embodiment, the ladder flag storage device comprises an enclosure attachable to the end of a ladder (e.g., along the side rail), the enclosure including an opening extending into an interior of the enclosure; a flag stored in the interior of the enclosure; an elastic cord disposed within the interior of the enclosure, a first end of the elastic cord anchored and a second end of the elastic cord attached to a first end of the flag; a guide on a surface of the interior of the enclosure to guide the elastic cord around an end of the enclosure; and a stop preventing the elastic cord from being removed from the enclosure through the opening. The flag is removed from the interior of the enclosure through the opening. In an embodiment, the flag can be removed from the enclosure by pulling a pull cap attached a second end of the flag.

DETAILED DESCRIPTION OF THE INVENTION

Figure 1A:
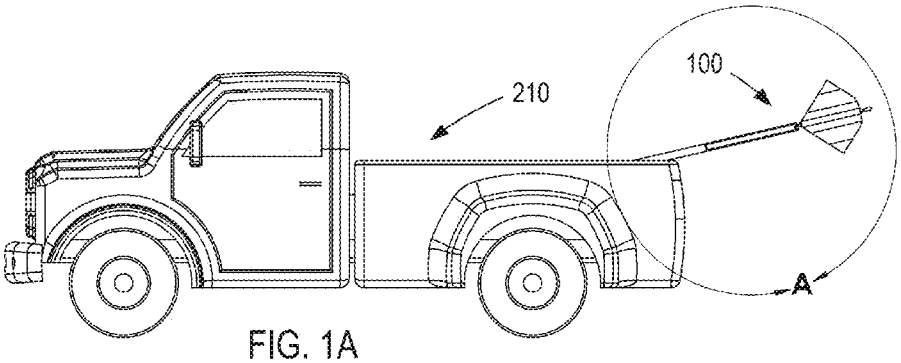
FIG. 1A illustrates a ladder flag storage device attached to the end of a ladder extending from a truck bed, according to an embodiment of the present invention.
Figure 1B:
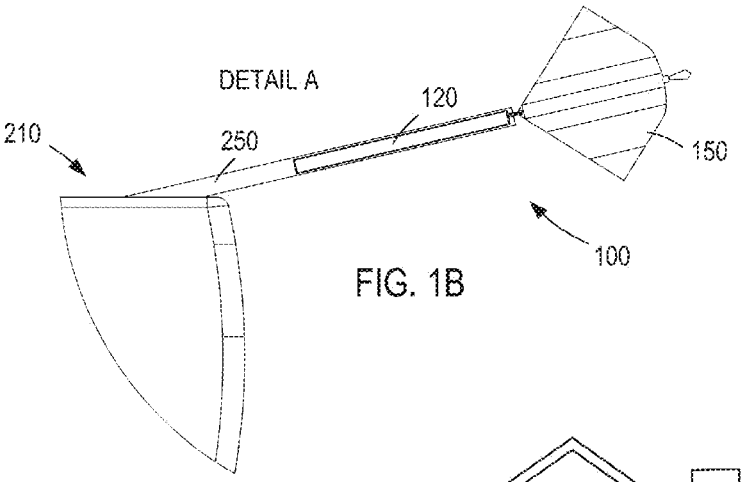
FIG. 1B illustrates a close-up view of the ladder flag storage device of FIG. 1.

FIG. 1A illustrates a ladder flag storage device 100 attached to a side rail of a ladder 250. As shown, the ladder 250 extends from the back of a truck bed 210 of a pickup truck but other types of vehicles, such as a utility truck, an SUV, etc., could be used to transport the ladder 250. FIG. 1B illustrates a closer view of the ladder flag storage 100 device. As can be seen, the ladder flag storage device 100 includes an enclosure 120 and a flag 150 extending from the enclosure 120. The enclosure 120 can be made from a sturdy plastic, such as acrylonitrile butadiene styrene (ABS), or a metal such as aluminum. The flag 150 can be made of a suitable material, such as cloth, plastic sheet, laminated paper, etc. The flag 150 can be deployed in accordance with safety protocols to warn drivers of the existence of the ladder 250 so as to keep a safe distance.

The ladder flag storage device 100 can be attached along the side rail (or on anther surface) of the ladder 250 by use of double-sided adhesive pads or tape, hook-and-loop fastening (e.g., Velcro), screwing or riveting, etc. Additionally, it is to be understood that in various embodiments the ladder flag storage device 100 may be made integral with the ladder 250. In an embodiment, the enclosure 120 can fit along inside edges of a ladder side rail.

Figure 2:
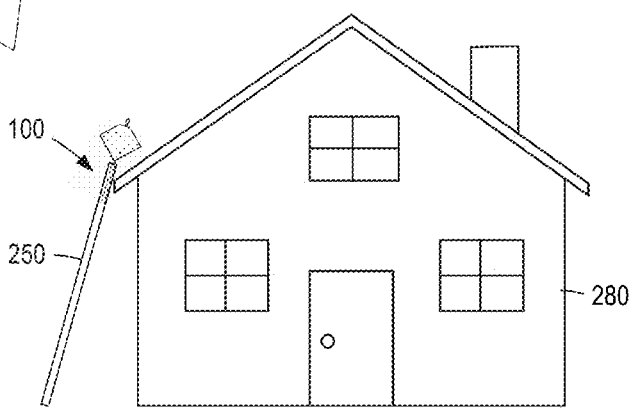
FIG. 2 illustrates the ladder flag storage device attached to the top of a ladder placed alongside a building.

FIG. 2 illustrates another usage of the ladder flag storage device 250. As shown, the ladder flag storage device 250 is attached to the top side of a ladder 250 that is placed alongside a building 280. Although the building 280 appears as a residential dwelling, it is to be appreciated that the ladder flag storage device 100 could instead be attached to the top side of on a ladder 250 that is placed alongside a commercial building, a garage, a wall, a bridge, or any other suitable structure. Furthermore, although the ladder 250 illustrated herein is a straight ladder, such as an extension ladder, the ladder flag storage device 100 can be used in conjunction with various other types of ladders, including step ladders and multi-purpose ladders. Finally, it is to be understood that while the device 250 is shown and described herein as being attached to the side of a ladder, the device 250 could be attached to a variety of different objects besides a ladder.

Figure 3A:
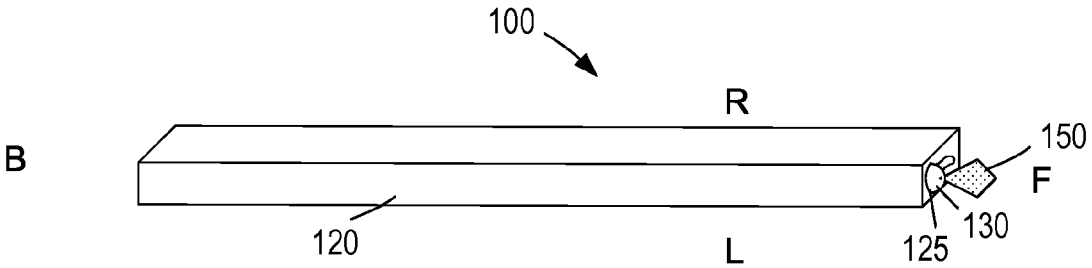
FIG. 3A illustrates a perspective view of the ladder flag device with the flag retracted.

FIG. 3A illustrates a perspective view of the ladder flag device 100 with the flag 150 stored therein. As depicted, the ladder flag device 100 is not attached to a ladder 250. At the front end of the ladder flag device 100, a pull cap 130 is placed over an opening 125. As will be described in greater detail, the opening 125 extends into a hollow interior of the enclosure 120 wherein the flag 150 is stored. A small portion of the flag 150 protrudes through a central hole in the pull cap 130. The width of the pull cap 130 is substantially larger than that of the opening 125 to prevent the pull cap 130 from entry into the enclosure 12. The pull cap may be made of a flexible material such as rubber so that it can be easily grasped.

Figure 3B:
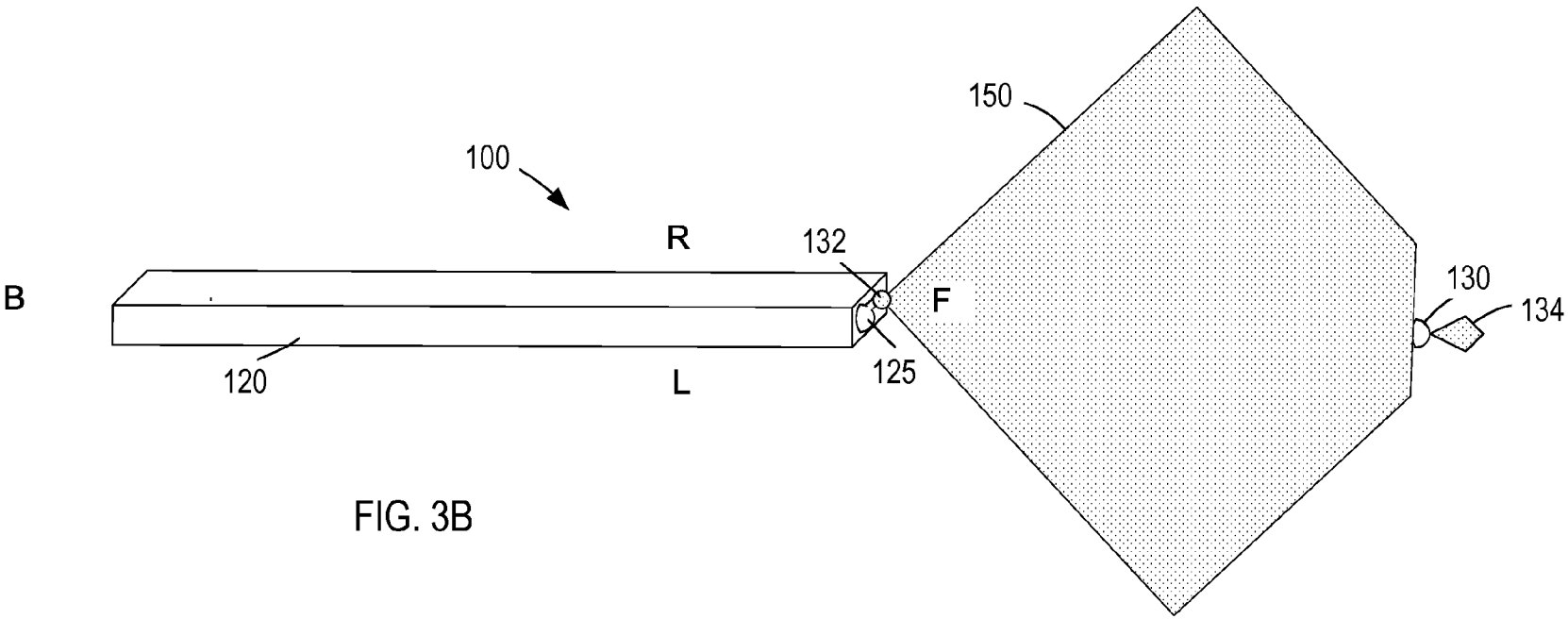
FIG. 3B illustrates a perspective view of the ladder flag device with the flag displayed.

FIG. 3B illustrates a perspective view of the ladder flag device 100 with the flag 150 displayed. As can be seen, the flag 150 is removed from the interior of the enclosure. A first end 132 of the flag 150 is connected to the device while a second end 134 is free. In the illustrated embodiment, the flag 150 can be removed from the enclosure 120 by grasping the pull cap 130 and outwardly pulling it.

Figure 4B:
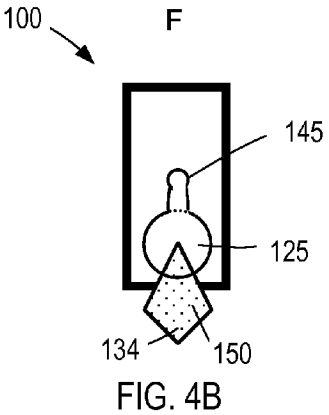
FIG. 4B illustrates a front view of the ladder flag device.
Figure 4A:
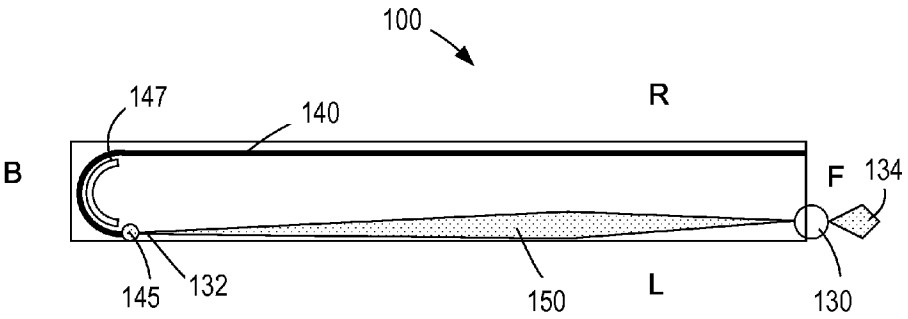
FIG. 4A illustrates a side cutaway view of the ladder flag device with the flag retracted.

FIG. 4A illustrates a side cutaway view of the ladder flag device 100 with the flag 150 stored therein. As shown, the interior of the enclosure 120 contains a cord 140, a cord guide 142, a connector 136 and the flag 150. As mentioned, the second end 134 of the flag 150 extends through a central hole in the pull cap 130. Although the pull cap 130 is shown shaped as a sphere, it is to be understood that the pull cap 130 could assume a different shape, e.g., a hemisphere, a cube, a cylinder, a torus, etc. Although various retraction mechanisms can be used to allow the flag 150 to be forcefully pulled back into the enclosure, such as retraction mechanisms using a spring, the illustrated embodiment shows usage of an elastic cord 140, preferably a bungee-type cord. Furthermore, it is to be understood that a substantially inelastic cord (e.g., a string or cable wire) could instead be attached to the flag 150. In such a case, however, the flag 150 would have to be placed back into the enclosure manually. It is to be understood that the present invention is not limited to the illustrated example.

As illustrated, the interior of the enclosure 120 includes a front wall F, a back wall B, a right-side wall R and a left-side wall L. In the illustrated embodiment, the cord is a bungee cord, and the cord 140 is fixedly attached (anchored) at or near a corner where the front wall F and the right-side wall meet. The cord 140 extends from this attachment point approximately parallel to the right-side wall until arriving at the guide 147 which curves around the back wall B. The guide 147 supports the cord 140 and when the cord 140 is pulled, the cord 140 hugs the guide 147. The cord then continues along the left side wall L for a short distance until it is attached to the first end 132 of the flag 150 using the connector 145, as shown.

FIG. 4B illustrates a front view of the ladder flag device 100. As can be seen, the entrance 125 is shaped as a slit. The connector 145 shown is a hog ring. In this case, the first end 132 of the flag 150 would overlap an end of the cord 140 with the hog ring clamping these together. The hog ring may be fastened using hog ring pliers, for example. If a hog ring is chosen for the connector 145, it should be wide enough when used such that it does not slip through the entrance 125 when the flag is removed. It is to be understood that various other types of connectors 145 may be used, such as a staple, sewing, etc., and in certain cases a separate "stop" (e.g., a ring disposed around the end of the cord 140) may also be needed to prevent the cord 140 from being removed from the enclosure 120. Additionally, the connector 145 can include a tube-like extender to hold the flag 150 a farther distance from the entrance 125.

Figure 4C:
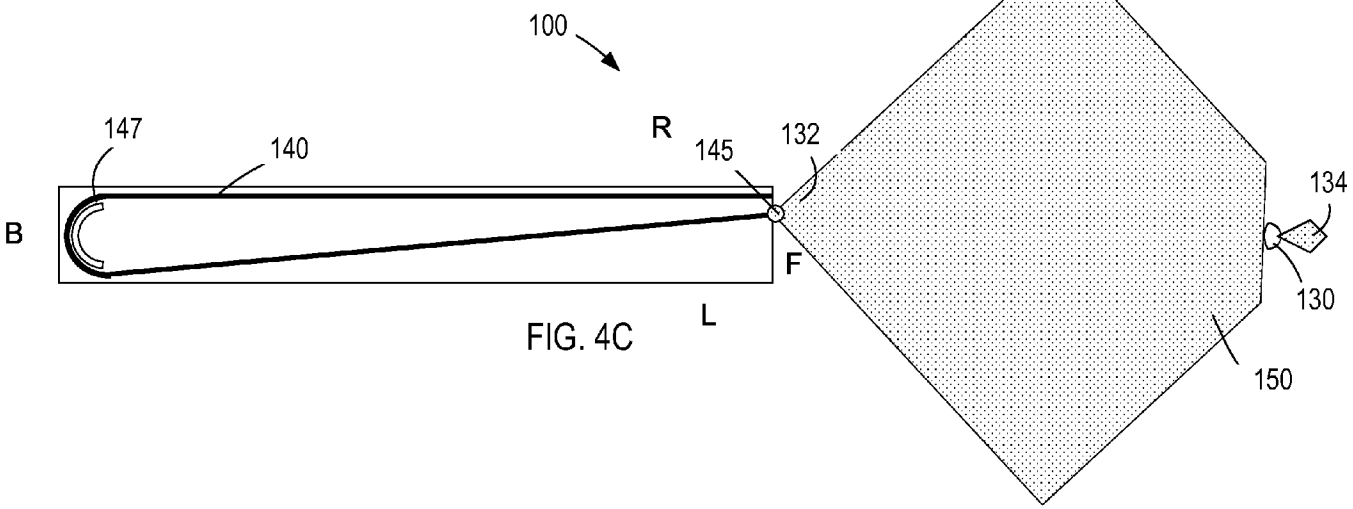
FIG. 4C illustrates a side cutaway view of the ladder flag device with the flag displayed.

FIG. 4C illustrates a side cutaway view of the ladder flag device 100 with the flag 125 displayed.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A ladder flag storage device, comprising:

an enclosure attachable to a ladder, the enclosure including an opening extending into an interior of the enclosure; and a flag stored in the interior pull capable of being removed through the opening and thereupon displayed;

wherein the enclosure fits along inside edges of a side rail of the ladder.

2. The ladder flag storage device of claim 1, wherein a cord is disposed within the interior of the enclosure, a first end of the cord anchored and a second end of the cord attached to a first end of the flag.

3. The ladder flag storage device of claim 2, wherein the cord is an elastic cord.

4. The ladder flag storage device of claim 3, wherein the elastic cord is a bungee cord.

5. The ladder flag storage device of claim 2, wherein the second end of the cord includes a hog ring to prevent the cord from being removed from the enclosure.

6. The ladder storage device of claim 3, wherein the interior of the enclosure includes a cord guide.

7. The ladder flag storage device of claim 2, further including a pull cap having a central hole, a second end of the flag inserted through the central hole.

8. The ladder flag storage device of claim 1, wherein the enclosure is attachable to a side rail of the ladder using an adhesive.

9. The ladder flag storage device of claim 1, wherein the enclosure is elongated.

10. The ladder flag storage device of claim 1, wherein the flag is retractable.

11. The ladder flag storage device of claim 1, wherein the enclosure is made of a plastic.

12. The ladder flag storage device of claim 1, wherein the enclosure is made of aluminum.

13. A ladder flag storage device, comprising:

an enclosure attachable to an end of a ladder, the enclosure including an opening extending into an interior of the enclosure;

a flag stored in the interior of the enclosure;

an elastic cord disposed within the interior of the enclosure, a first end of the elastic cord anchored and a second end of the elastic cord attached to a first end of the flag;

a guide on a surface of the interior of the enclosure to guide the elastic cord around and an end of the enclosure; and a stop preventing the elastic cord from being removed from the enclosure through the opening;

wherein the flag is pull capable of being removed from the interior of the enclosure through the opening.

14. The ladder flag storage device of claim 13, wherein the stop is a hog ring attaching the second end of the elastic member and a first end of the flag.

15. The ladder flag storage device of claim 13, further including a pull cap having a central hole, a second end of the flag inserted through the central hole.

16. The ladder flag storage device of claim 15, wherein the pull cap is substantially spherical.

17. The ladder flag storage device of claim 13, wherein the enclosure is attachable to the end of the ladder using an adhesive.

18. The ladder flag storage device of claim 13, wherein the enclosure fits along inside edges of a ladder side rail.

19. A ladder flag storage device, comprising:

an enclosure attachable to a ladder, the enclosure including an opening extending into an interior of the enclosure;

a flag stored in the interior pull capable of being removed through the opening and thereupon displayed; and a pull cap having a central hole, a second end of the flag inserted through the central hole.

20. The ladder flag storage device of claim 19, wherein the pull cap is substantially spherical.

* * * * *